US007033489B2

(12) United States Patent
Thompson et al.

(10) Patent No.: US 7,033,489 B2
(45) Date of Patent: Apr. 25, 2006

(54) DRAINAGE ASSEMBLY

(75) Inventors: Keith Thompson, Shifnal (GB); John Neil Pickavance, Bingham (GB); Alan Jack Pendleton, Mowbray (GB)

(73) Assignee: Saint-Gobain Pipelines plc, Ilkeston (GB)

( * ) Notice: Subject to any disclaimer, the term of this patent is extended or adjusted under 35 U.S.C. 154(b) by 0 days.

(21) Appl. No.: 10/743,499

(22) Filed: Dec. 23, 2003

(65) Prior Publication Data

US 2004/0238424 A1 Dec. 2, 2004

(51) Int. Cl.
*E03F 5/06* (2006.01)

(52) U.S. Cl. ..... 210/164; 210/232; 210/474; 404/4; 404/25

(58) Field of Classification Search ..... 210/163, 210/164, 232, 474, 477; 404/2, 4, 5, 25
See application file for complete search history.

(56) References Cited

U.S. PATENT DOCUMENTS

| | | | | |
|---|---|---|---|---|
| 386,768 | A * | 7/1888 | Burrows | 210/164 |
| 1,711,674 | A * | 5/1929 | Egan | 210/163 |
| 3,674,149 | A * | 7/1972 | Donalson | 210/163 |
| 3,881,832 | A * | 5/1975 | Maguire | 210/164 |
| 4,126,404 | A * | 11/1978 | Ferns | 210/163 |
| 4,364,689 | A * | 12/1982 | Dumortier | 210/164 |
| 4,952,094 | A * | 8/1990 | Spiess et al. | 404/4 |
| 4,955,752 | A * | 9/1990 | Ferns | 404/4 |
| 5,324,135 | A * | 6/1994 | Smith | 210/164 |
| 5,864,990 | A * | 2/1999 | Tu | 210/163 |
| 2004/0238424 | A1 | 12/2004 | Thompson et al. | |
| 2005/0230295 | A1 * | 10/2005 | Monneret | 210/164 |

FOREIGN PATENT DOCUMENTS

| | | |
|---|---|---|
| EP | 0 085 306 | 8/1983 |
| EP | 0 506 591 | 9/1992 |
| GB | 1 230 448 | 5/1971 |
| GB | 1 543 267 | 3/1979 |
| GB | 2 355 038 | 4/2001 |

* cited by examiner

*Primary Examiner*—Christopher Upton
(74) *Attorney, Agent, or Firm*—Oblon, Spivak, McClelland, Maier & Neustadt, P.C.

(57) ABSTRACT

A drainage assembly (10) comprises a frame (11) for defining at least part of the surface boundary of a surface drainage aperture; and a grating (14) having formed therein a plurality of apertures. The grating (14) is hingedly secured to the frame (11) and is moveable, when so secured, between an operative position in which the grating (14) is contiguous with the frame (11); and an open position in which the grating (14) lies hinged away from the frame (11).

The grating (14) includes protruding therefrom a pair of forks (34, 36). The frame (11) includes a pair of journal bearings (37, 38). The forks each have protruding therefrom a respective protuberance (39) that is receivable in a respective journal recess (42) formed in the journal bearings.

At least one of the said forks (34, 36) is resiliently deformable and the locations of the respective protuberances (39) and journal recesses (42) are such as to urge the said protuberances (39) into associated said journal recesses when the grating (14) and the frame (11) are secured together.

23 Claims, 11 Drawing Sheets

DRAINAGE ASSEMBLY

This invention relates to a drainage assembly. In particular the invention relates to a kind of drainage assembly known as a gully grate; although the invention is also applicable to other drainage assemblies such as road drains and sump grates.

A gully grate typically comprises an annular frame that is anchored adjacent the surface of a gully defined in eg. a road, pathway, playground or parking area, overlying a drainage duct so as to define a boundary between the duct and the gully.

A grating is secured to the frame so as partly to close the aperture defined thereby.

The grating includes an array of members that cross one another to define a reticulated grating through which liquids such as rainwater may pass, en route from the gully to the drainage duct. The sizes and locations of the apertures defined in the grating are such as to permit the ready flow of liquids from the gully to the duct; yet prevent the passage thereinto of debris (eg. leaves, stones and litter) entrained in the flowing liquid.

In most gully gates the frame defines eg. a rectangular, annular recess having protruding inwardly therefrom, towards the middle of the annulus, one or more seatings for supporting the underside of the grating so that the top of the latter lies generally flush with the top surface of the frame, with the major part of the grating received within the recess.

It is desirable for the grating to be removable from the frame for purposes of cleaning and/or unblocking the trap defined thereby; and of gaining access to the drainage duct. The latter may be necessary eg. for inspecting, unblocking or repairing the duct; or during the application of chemicals to the duct.

In some gully grates the grating is completely removable from the frame.

This design is associated with the disadvantage that the gating may readily be removed illicitly eg. for purposes of theft of the material of the grating or removal (in some locations) by vandals.

The grating can be deliberately made difficult to remove eg. by designing the recess in the frame as a tapered shape and making the exterior of the grating of complementary shape. However this arrangement is sub-optimal because the grating and frame can become wedged together and stuck, thereby making it inconvenient for an authorised user to open the grating.

It has become commonplace for gratings to include, projecting on opposite sides and at one end thereof, a pair of hinge pins. The hinge pins are received in apertures formed in the frame such that the grating and frame are, at one end of the frame, hingedly secured together.

The arrangement of the components is such that the grating is hingeable between a closed position, in which it is received neatly in the recess, and an open position in which it is upstanding from one end of the recess.

Hingeable securing of the grating in this manner ameliorates the problems outlined above, but creates a further problem during manufacture of the drainage assemblies.

Specifically, each of the two components of the assembly is typically cast as a single item, eg. from iron. The general brittleness of cast metals means that hitherto one way of forming the hinge pins has been by passing bolts through mutually aligned apertures formed in the grating and the frame; and then securing nuts onto the ends of the bolts to secure the hinge parts together. The shanks of the bolts then act as the hinge pins in the apertures.

As an alternative to the bolts, it is known to use interference fit pins to define the hinges. The pins require driving into eg. the frame so as to protrude therefrom and rest, with a clearance, in apertures formed in the grate.

Bolting or pinning together of the components in the aforesaid ways to define hinged joints is time consuming to carry out. Additionally it increases the number of components needed to manufacture the assembly. Also of course the bolts or pins are susceptible to removal by thieves and others; or loss eg. in transit.

According to a first aspect of the invention there is provided a drainage assembly comprising a frame for defining at least part of the surface boundary of a surface drainage aperture; and a grating having formed therein a plurality of apertures. The grating is hingedly securable to the frame and moveable, when so secured, between an operative position in which the grating is contiguous with the frame and an open position in which the grating lies hinged away from the frame. The frame and the grating include mutually engageable hinge parts comprising a first pair of forks protruding from the grating and a pair of journal members secured to the frame, one of the first pair of forks and the pair of journal members each having protruding therefrom a respective protuberance and the other of the first pair of forks and the pair of journal members each having formed therein a respective journal recess in which the protuberance is rotatably receivable when the frame and the grating are hingedly secured together. At least one of the forks and/or journal members is moveable against a resilient biasing to permit fabrication and dismantling of the drainage assembly. Means are provided for substantially preventing at least one of the protuberances rotatably received in one of the journal recesses from being removed from the journal recess when the grating is in the operative position.

The resilient moveability of at least one fork of the assembly greatly speeds up the assembly of the parts of the device. In a preferred embodiment of the invention the moveability derives from resilient deformability of one of the forks.

At the same time the protuberances, that preferably are of cylindrical shape, are journalled in the recesses (that are of complementary profile to the protuberances) to define robust, freely movable hinges that are difficult to dismantle.

In preferred embodiments of the invention both of the first pair of forks are resiliently deformable.

This advantageously permits manufacture of the grating as a single item eg. by casting.

In another embodiment of the invention the journal bearings are defined as a second pair of forks protruding from the frame. In a particularly preferred embodiment the second pair of forks include the recesses formed therein eg. as a result of casting or machining.

Preferably the forks protruding from the grating are resiliently deformable. This allows practising of an assembly method as aforesaid.

Resilient deformability of at least the forks protruding from the grating is achievable through the choice of material used to manufacture the grating; the dimensions of the forks (and in particular the ratio of the length to the thickness of the forks); or, preferably, a combination of the choice of material and the dimensions of the forks.

Of course it is within the scope of the invention to provide different arrangements.

For instance the recesses may be defined in the first pair of forks, instead of in the journal members. Consequently the protuberances could be projections protruding from parts of the fame in locations suitable for receipt in the recesses.

In a particularly preferred embodiment of the invention the grating, including the first pair of forks, is formed from spheroidal graphite iron. This material confers particularly suitable properties of resiliency on the forks, while also exhibiting other properties desirable in a mass produced item.

Preferably the resilient deformability of the or each deformable fork permits deflection of parts of the assembly of the invention one relative to another, to permit insertion of the protuberances into the recesses during construction of the assembly.

Preferably, when the resilience of the or each resiliently deformable fork is as aforesaid, the recesses are formed in the respective journal members; and at least one of the journal members includes a groove interconnecting a free edge of the journal member and its associated recess, the groove being so dimensioned and located as to permit sliding therein of an associated said protuberance, following the said deflection, until the protuberance is received in the said associated recess.

This arrangement facilitates manufacture of the drainage assembly since the groove can act as a guide for guiding the protuberance into the recess.

Moreover the presence of the groove minimises the extent to which the forks require bending apart, against their resilience, to allow manufacture of the drainage assembly.

In practical embodiments of the invention both the journal members include grooves as aforesaid.

Conveniently the cross-sectional shape of the said associated protuberance includes major and minor axes whereby the protuberance is slideable in the groove only when the grating is inclined at a predetermined angle relative to the frame.

This feature enhances the security of the hinge, since in the overwhelming majority of positions to which the grating is hingeable the protuberances are not slideable along the groove(s). This makes it essentially impossible to remove the grating from the frame unless the grating is first hinged to the aforementioned predetermined position.

In a preferred embodiment of the invention when the grating adopts a predetermined angle relative to the frame, following receipt of the said protuberance in its associated recess, the recess obscures from external view the existence of the minor axis of the cross-sectional shape of the protuberance.

This further enhances the security of the hinge since when the grating is in its operative position it is not evident to an observer that the protuberance has major and minor axes only one of which is small enough to pass along the groove.

Preferably the drainage assembly includes a lock arrangement for securing the grating in its operative position, the lock arrangement comprising a first lock member protruding from the frame and a second lock member protruding from part of the grating, the first and second lock members being:

(i) moveable transversely relative to one another against a resilient biassing; and (ii) positioned such that on hinging of the grating to its operative position the second lock member passes downwardly past the first lock member following or during transverse relative movement between the lock members; and the lock members including, when the lock is operative to secure the grating in its operative position, a first pair of mutually juxtaposed surfaces that react against the resilient biassing; and a second pair of mutually juxtaposed surfaces that oppose a second resilient biassing tending to hinge the grating towards its open position.

When the lock arrangement is in use to secure the grating in its operative position the first lock member conveniently obscures at least one of the pairs of juxtaposed surfaces, when the drainage assembly is viewed from above.

This feature makes it harder for an observer to deduce how to unlock the grating.

In embodiments of the invention in which the frame is rectangular the axis of hinging of the grating may be arranged to be parallel to the longer sides or alternatively the shorter sides of the rectangle. Thus the grating may be "kerb hinged" or "end hinged".

Conveniently the frame is rectangular and is formed from an integral, generally U-shaped member having a plate secured thereto interconnecting the free ends of the limb of the "U".

Conveniently the frame includes an anchor for securing the assembly relative to a ground surface drainage aperture.

In preferred embodiments of the invention the anchor may include one or more protrusions or recesses formed on the frame for keying the frame in a bedding medium.

It is also preferable that the protrusions or recesses additionally stiffen the frame against bending.

The protrusions or recesses may occur on any part of the assembly intended to provide an anchoring function. In a particularly preferred embodiment the frame includes protruding therefrom a flange; and the protrusions or recesses are formed in or on a surface of the flange. In preferred embodiments of the invention the flange presents upper and lower surfaces, although other arrangements are possible.

The protrusions or recesses may lie on one or other, or both, of the aforesaid flange surfaces.

Any of the embodiments of the invention disclosed herein may include a flange, regardless of whether the flange bears protrusions or recesses. In any such embodiment the extent of protrusion of the flange may vary from place to place about the periphery of the frame. This advantageously saves material in locations where the flange need not be broad.

Preferably a flange protrudes outwardly from the exterior of a lower part of the frame, although other arrangements are possible within the scope of the invention.

It is also preferable that the frame defines a continuous boundary of eg. rectangular or square shape. It is conceivable, however, that the frame may be discontinuous eg. a U-shape.

Using the arrangement of the invention, it is readily possible during assembly of the components to locate the grating over the frame and align the protuberances on the grating above their associated recesses. Applying a downward pressure on the grating will then force the protuberances to simultaneously slide on surfaces of the frame or in the aforesaid groves, if present, and snap into position in their associated recesses.

The resilient deformability of the forks on the grating and/or on the frame allows this engaging action, permitting deflection of the forks. Consequently the assembly step is quick and convenient, and obviates the need for extra components such as the bolts and nuts or hinge pins.

In an alternative assembly arrangement, one of the protuberances is initially placed into its associated recess. The grating may then be manoeuvred so that the other protuberance of the pair enters the other recess. During this process the latter protuberance slides on a surface of the frame or the groove. The resilient nature of the fork permits its deflection to allow the latter protuberance to slide into its associated recess.

Once the protuberances enter their associated recesses the resilient deformability of the forks urges both the protuberances to remain within their recesses, thereby making complete removal of the grating from the frame very difficult.

In a preferred embodiment the upper surface of the grating is provided with projections that slow the flow of the fluids over the drainage assembly thereby encouraging a greater amount of water to fall through the drain. The projections can be raised shapes or lettering on the grating surface.

There now follows a description of a preferred embodiment of the invention, by way of non-limiting example, with reference being made to the accompanying drawings in which.

Figure 8C:
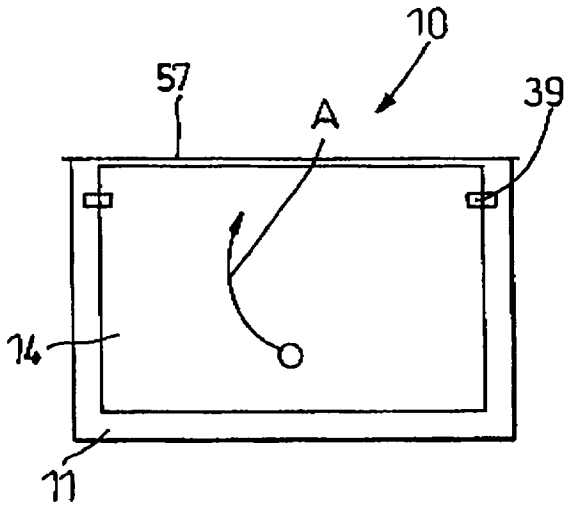
Figure 8B:
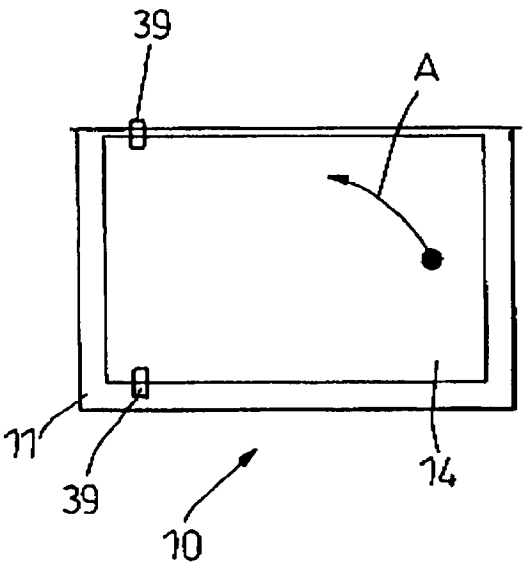
Figure 8A:
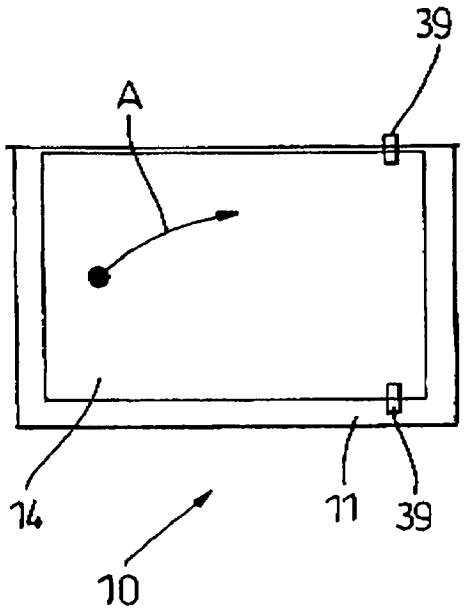
Figure 9:
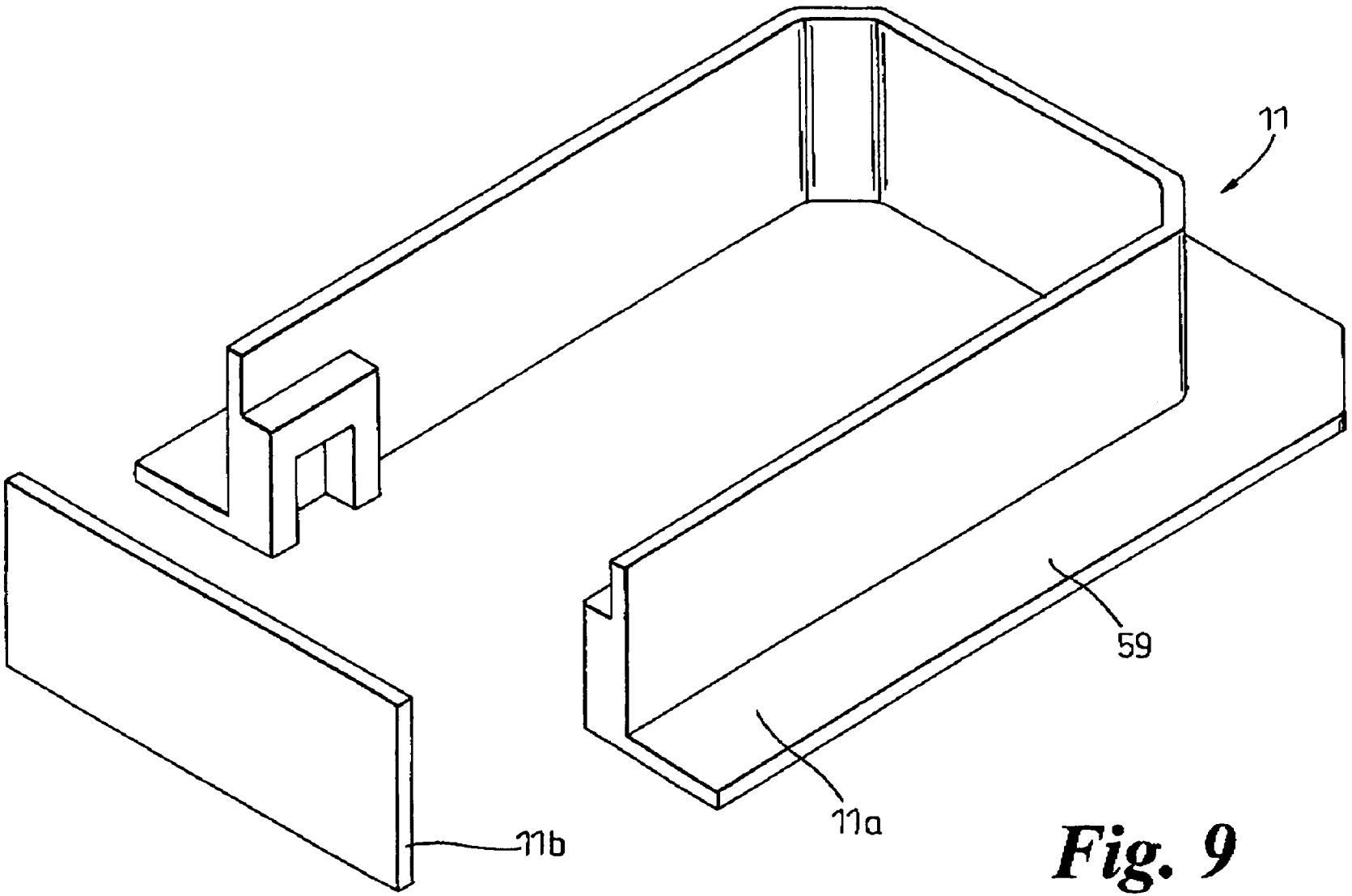
Figure 10:
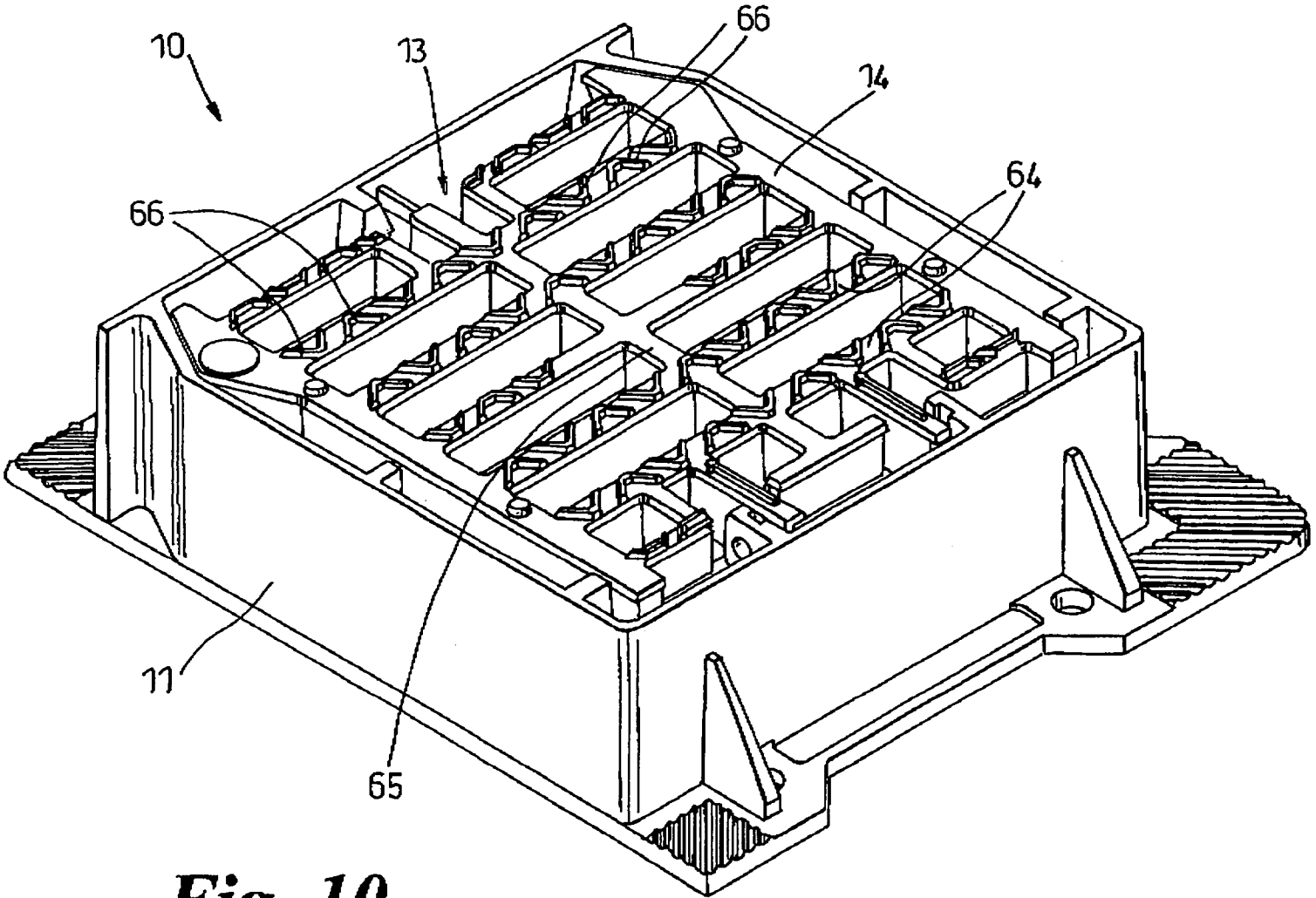
Figure 11:
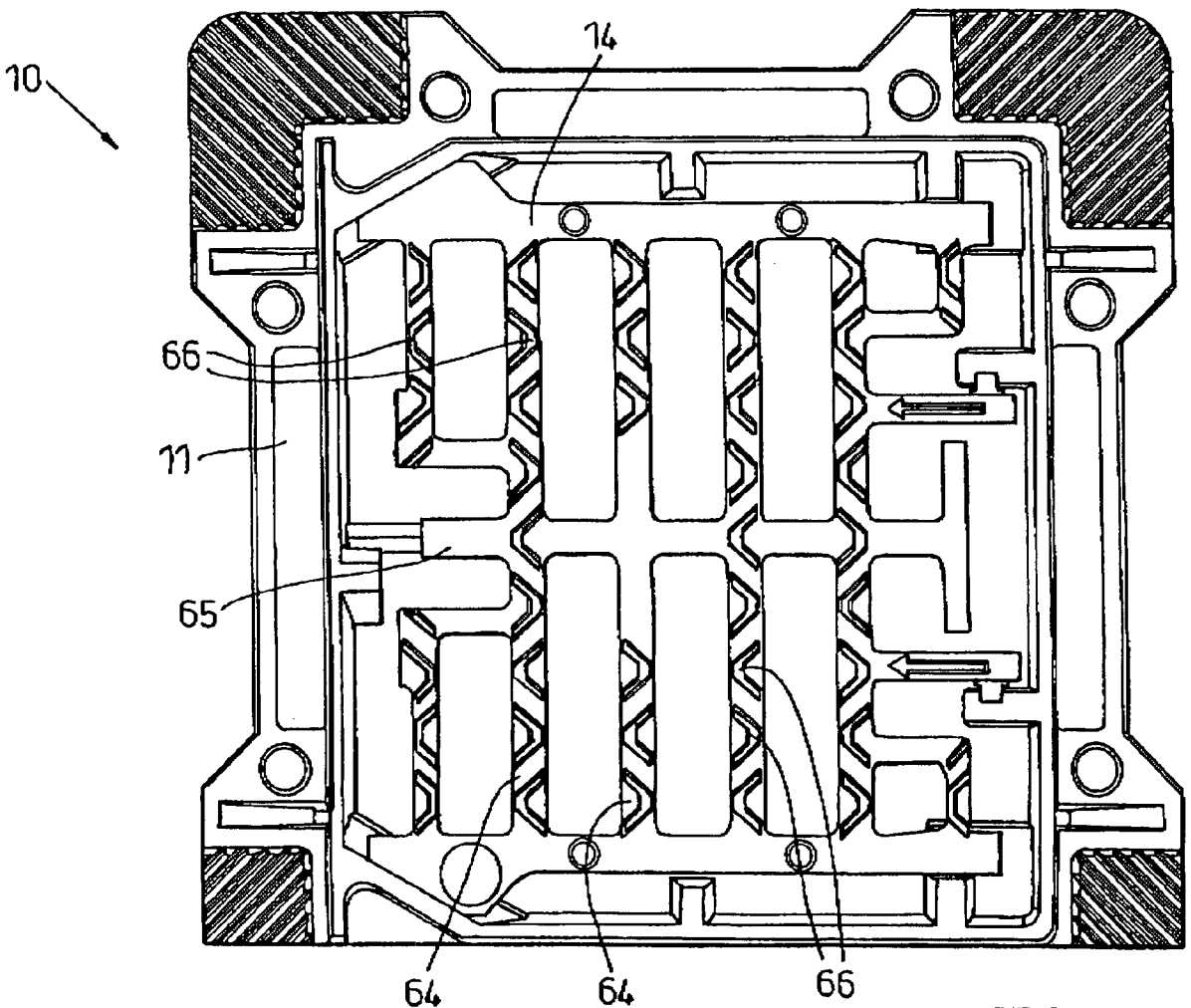

FIGS. 8*a*, 8*b* and 8*c* are schematic views showing possible hinging arrangements within the scope of the invention;

FIG. 9 is a schematic, perspective view of possible frame arrangements within the scope of the invention;

FIG. 10 is a perspective view of another embodiment of a drainage assembly according to the invention, showing water deflectors on the surface of the grating; and FIG. 11 is a plan view of the drainage assembly of FIG. 10.

Referring to the drawings, a drainage assembly 10 comprises a frame 11 that in the embodiment shown is a rectangular annulus. The annulus is defined by a vertically extending wall 12 that is continuous and defines the rectangular shape of the frame when viewed in plan.

The frame 11 is intended in use of the drainage assembly 10 to define the surface boundary of a surface drainage aperture, such as an aperture that leads into a drainage duct or pipe.

For this purpose the wall 12 is sufficiently deep to allow it to be set into material surrounding the open (typically upper) end of the surface drainage aperture. In practice the material surrounding the aperture would be a mortar or similar material that serves to key the frame and fasten it relative to the aperture.

Frame 11 defines a frame recess 13 having moveably received therein a grating 14. Recess 13 is in the preferred embodiment rectangular when viewed in plan, although it may in other embodiments adopt any of a range of other regular or irregular shapes.

In the embodiment shown in FIGS. 1 to 9 grating 14 is a one-piece component principally defined by three mutually parallel, mutually spaced rails 15, 16, 17. The rails 15, 16, 17 essentially span two diagonally opposite corners 21, 23 of the four corners 19, 21, 22, 23 or fame 11. Rails 15, 16, 17 are interconnected as part of an array of interconnected members 18 to define the reticulated structure shown, having a pattern of through-going apertures formed therein. The apertures readily permit flow of eg. rainwater therethrough yet prevent the passage of objects such as leaves and litter that might otherwise block the drainage duct or pipe to which the assembly 10 is in use secured.

Of course the precise arrangement of the members defining the appearance of grating 14 may be varied at the option of the designer thereof The arrangement shown is one of many essentially equivalent arrangements that will occur to one of ordinary skill in the art of drainage product design. By way of example, another arrangement is illustrated in the drainage assembly drawings of FIGS. 10 and 11.

The precise pattern of the members 15, 16, 17, 18 shown has the effect of inducing non-streamline flow of a body of water passing over the drainage assembly 10. This in turn reduces the average velocity of such water, with the result that more of the water flows down the drainage duct than would be the case for faster flowing water.

The outer periphery of grating 14 is when viewed in plan essentially of complementary shape to that of frame recess 13, whereby grating 14 is moveably receivable within frame recess 13.

Figure 1:
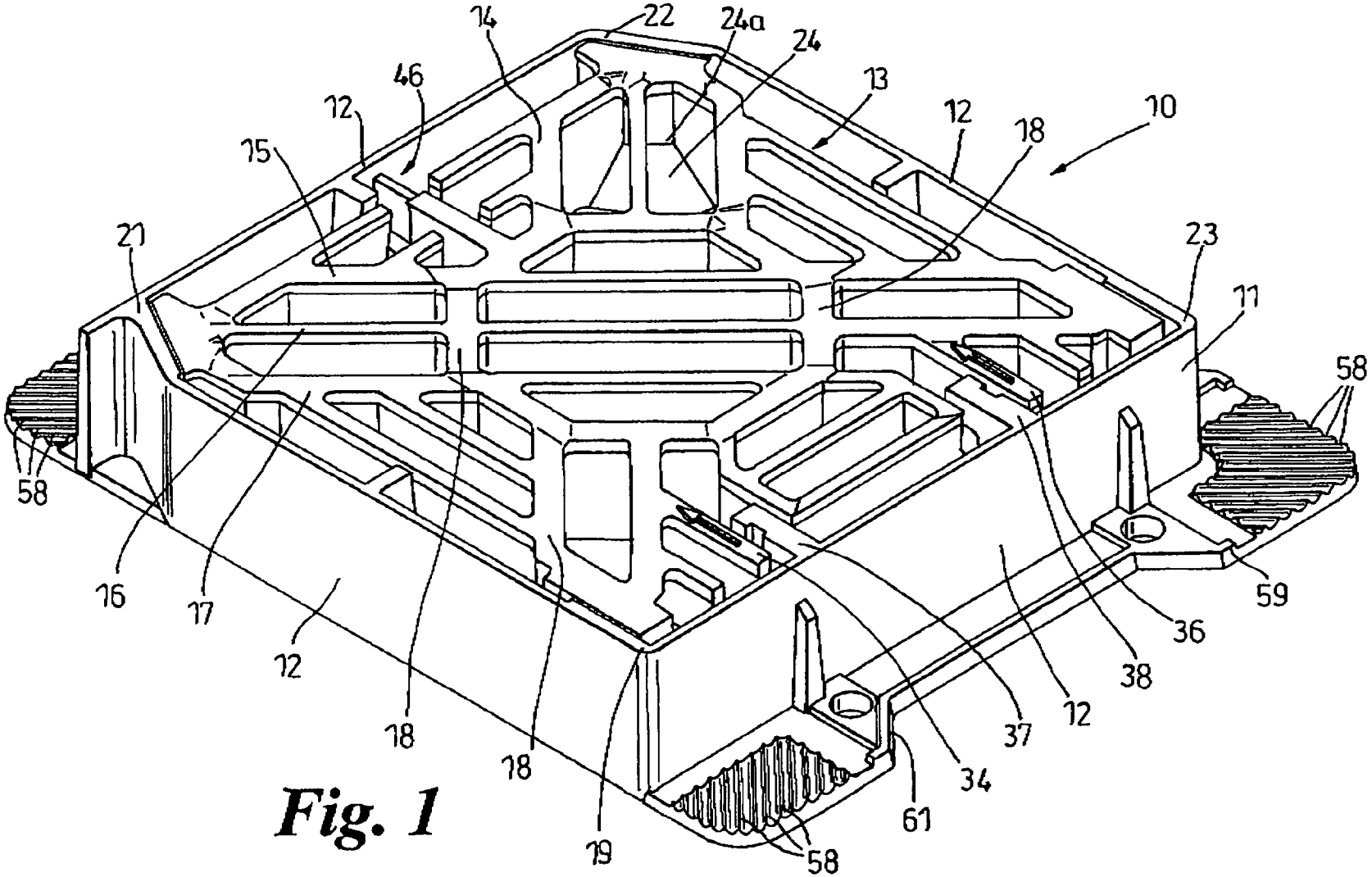
FIG. 1 is a perspective view of a drainage assembly according to the invention, showing the grating thereof secured in its operative position.

Recess 13 includes defined at each corner 21 and 22 a seating of which one, labelled 24, is visible in FIG. 1.

The seatings each present an upwardly facing surface 24*a* that lies below the upper, free edge of wall 12.

The underside of each corner of frame 14 that is, in use, adjacent a corner seating such as 24 includes a downwardly facing surface that rests against surface 24*a* when the grating occupies its operative position. The dimensions of the components are such that as a result the upper surface of grating 14 lies flush with the upper, free edge of wall 12 when grating 14 is in its operative position. When the drainage assembly 10 is installed in a road etc. the top of grating 14 and the upper edge of wall 12 lie flush with the road etc. surface.

At one end grating 14 includes projecting therefrom in a direction parallel to the rails 15, 16, 17 a pair of elongate forks 34, 36.

The forks 34, 36 coact with journal bearings 37, 38 that are in the FIG. 1 embodiment secured at the opposite end of frame 11 to corners 21, 22, on the interior of frame recess 13 in a manner described below, to provide for hingeable securing of the grating 14 and the fame 11 together.

Figure 3:
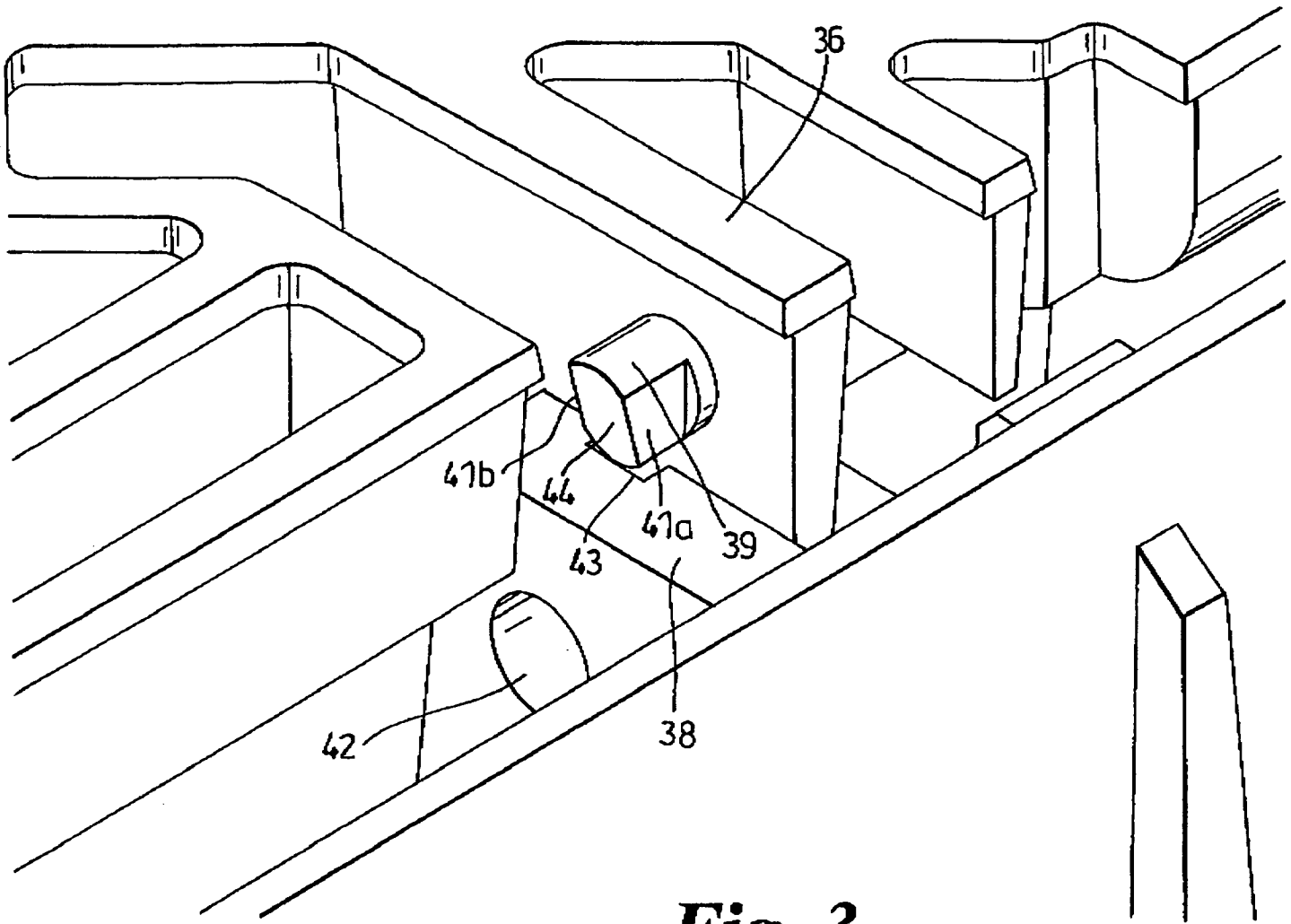
FIG. 3 shows in perspective view a part of the FIG. 1/2 assembly defining a hinge, during manufacture thereof.
Figure 4:
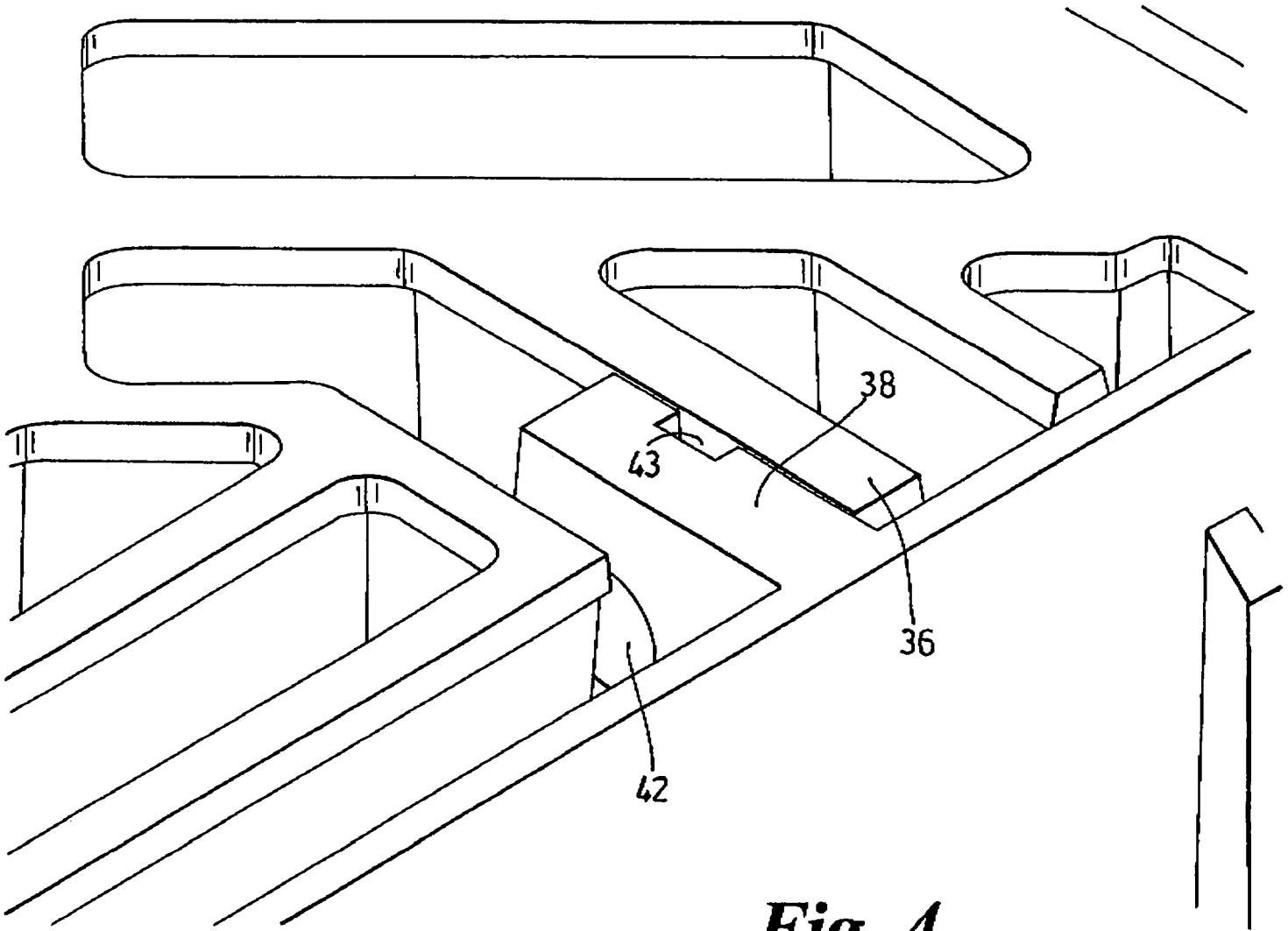
FIG. 4 shows the FIG. 3 components following completion of the manufacture of the drainage assembly.
Figure 5:
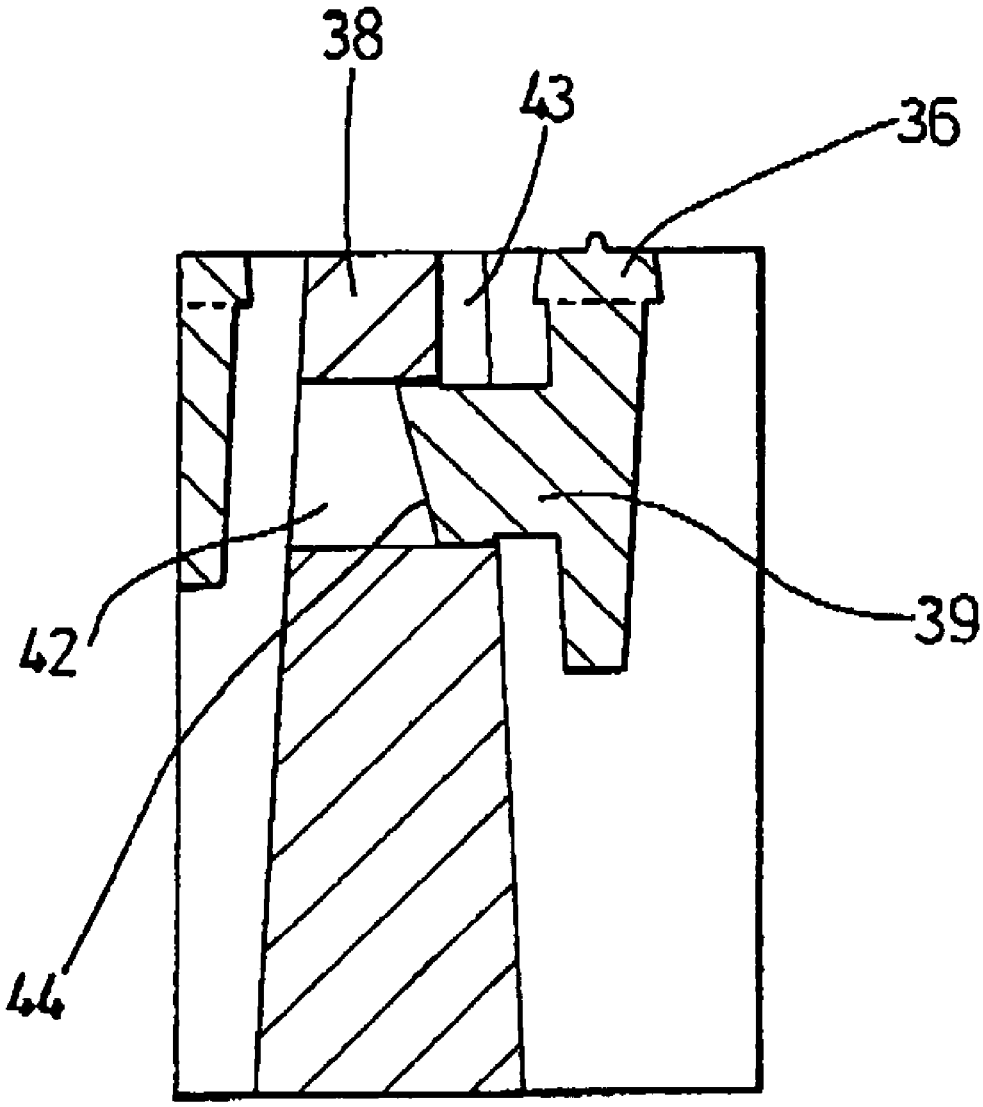
FIG. 5 is a vertically sectioned view of the hinge of FIGS. 3 and 4.

Each of the forks 34, 36 has protruding at right angles to its free end a part-cylindrical protuberance of which one, 39, that protrudes from fork 36 is visible in FIGS. 3 and 5. The other part-cylindrical protuberance, protruding from fork 34, is a mirror image of that shown in FIGS. 3 and 5.

Each of the aforesaid protuberances protrudes perpendicular to the elongate dimension of its associated fork 34, 36. The respective protuberances protrude horizontally in use of the assembly 10 in opposite directions at the same level relative to the remainder of grating 14.

As best seen in FIG. 3, each protuberance is formed as a cylinder, as exemplified by protuberance 39, that is truncated on opposite sides by parallel flats 41*a*, 41*b*. Thus the outer periphery of each protuberance presents four faces, two of which (on opposite sides of the protuberance) are flat and parallel to one another; and the other two of which (lying intermediate the flat faces) are arcuate.

As best seen in FIG. 3, the free end 44 of each protuberance tapers in a downward direction. The purpose of the taper is described below.

The cross-sectional shape of each protuberance defines therein mutually perpendicular major and minor axes, ie. dimensions of the protuberance cross-section. In each case the distance between the flats defines the minor axis and the distance separating the extremities of the arcuate surfaces the major axis.

The length of the major axis is too great to allow the arcuate surf aces of the protuberance to clear the sides of a groove (described below) in which the protuberance is slideable. The length of the minor axis permits such sliding, however, when the protuberance is in a predetermined orientation.

Each journal bearing 37, 38 is defined by a block of material that is integral with the frame 11. Each block has formed therein a circular journal recess which one, 42, is visible in FIGS. 3 and 4. Each journal recess acts as a journal for the associated protuberance such as 39 that is received therein during construction of the assembly.

Of course, other recess shapes lie within the scope of the invention but the circular shape is suitable for forming by casting.

The face of each journal bearing 37, 38 adjacent the associated fork 34, 36 has formed therein a downwardly extending, parallel sided, rectangular section groove 43 in which on 6, of the protuberances is slideable during fabrication of the drainage assembly 10.

At least one, and in practice both, of the forks 34, 36 is resiliently deformable. This is in the embodiment shown achieved through casting of the grating 14 from ductile iron and preferably ductile iron with an elongation threshold of between 3% and 7%; and through judicious choice of the ratio of the thickness of each fork 34, 36 to its length measured along its elongate dimension.

The grating 14 and/or the frame 11 may if desired be manufactured from other resiliently deformable materials such as but not limited to steel. The grating and indeed the whole drainage assembly 10 need not be manufactured by casting; but casting is particularly suitable for forming of the components from iron.

The resilient deformability of the forks permits ready and quick construction of the drainage assembly. In the illustrated, preferred embodiment of the invention this is achieved by rotating the grating 14 to orient the flats 41 on the protuberances to lie parallel with the parallel sides of the associated grooves 43; aligning the flats so that the ends 44 of the protuberances enter the upper ends of the grooves 43; and pressing downwardly on the grating 14.

This causes the tapered free end 44 of each protuberance to engage the corner defined at the upper end of each groove 43. Such engagement spreads the forks 34, 36 apart from one another against the resilience thereof.

The flats 41*a*, 41*b* of each protuberance are spaced sufficiently closely together that when the protuberances are orientated as shown the ends of the protuberances then slide downwardly in the associated grooves, with a small clearance between each flat and the adjacent groove wall.

Once each protuberance reaches the associated cylindrical journal recess 42 the resilience of the forks forces it thereinto, with the result that the protuberances are securely, rotatably journalled relative to the remainder of the frame 74. Consequently it is very difficult for an unauthorised person to dismantle the assembly 10.

The radius of curvature of the arcuate parts of each protuberance is only slightly less tan the radius of its associated journal recess 42. Consequently the journalling is smooth, precise and substantially free of play.

Other embodiments of the invention may omit one or more of the grooves 43. In such embodiments the assembly technique might involve locating one of the protuberances 39 into its associated journal recess 43; and then drawing the other protuberance across the exposed face of its associated journal block until it enters the other journal recess 43. The resilient deformability of the forks 34, 36 permits their deflection during the aforesaid motion. The resilient deformability also urges the protuberances 39 into the recesses 43 following completion of the construction steps. In such embodiments of the invention the protuberances may be entirely cylindrical if desired.

As suggested by FIG. 1, which shows the grating 14 spaced a short distance away from the frame 11 at one end thereof, as a result of the above-described arrangement the grating 14 is hingeable between its operative position, described above, in which it is received within and contiguous with frame recess 13; and an open position (an example of which is visible in FIG. 2) in which it is hinged away from the frame 11.

In the latter position the grating 14 may lie upstanding from one end of the frame 11. When fully open the grating is inclined slightly relative to the vertical, with the forks 34, 36 resting against the wall 12. Consequently grating 14 remains in an open position until it is deliberately pushed shut.

When the grating is in its operative position the flats 41 on the protuberances are oriented as indicated in FIG. 3. Thus when as illustrated in FIG. 5 each protuberance is received in its associated recess 42 an observer locking down on the assembly 10 sees only an arcuate surface of each protuberance, the flats being obscured from view. It would not be obvious that the flats 41*a*, 41*b* are present unless the grating is rotated out of its operative position. Such rotation would however move the flats out of parallel alignment with the sides of the grooves 43 so that the protuberances could not pass therealong.

The nature of the hinge discourages opportunist theft or removal of the grating 14.

A releasable lock 46, defined at the opposite end of grating 14 to that at which it is hinged, further enhances the security of the assembly by permitting locking of the grating in its operative position.

Lock 46 comprises a first lock member 47 protruding from the frame 11; and a second lock member 48 protruding from the grating 11.

Lock member 48 is resiliently deformable (eg. by virtue of its dimensions and/or material of manufacture) laterally relative to first lock member 47.

First lock member 47 includes an upwardly tapering, laterally facing surface 49. Second lock member 48 includes a downwardly tapering, laterally facing surface 51 that tapers at generally the same angle as surface 49.

Figure 6:
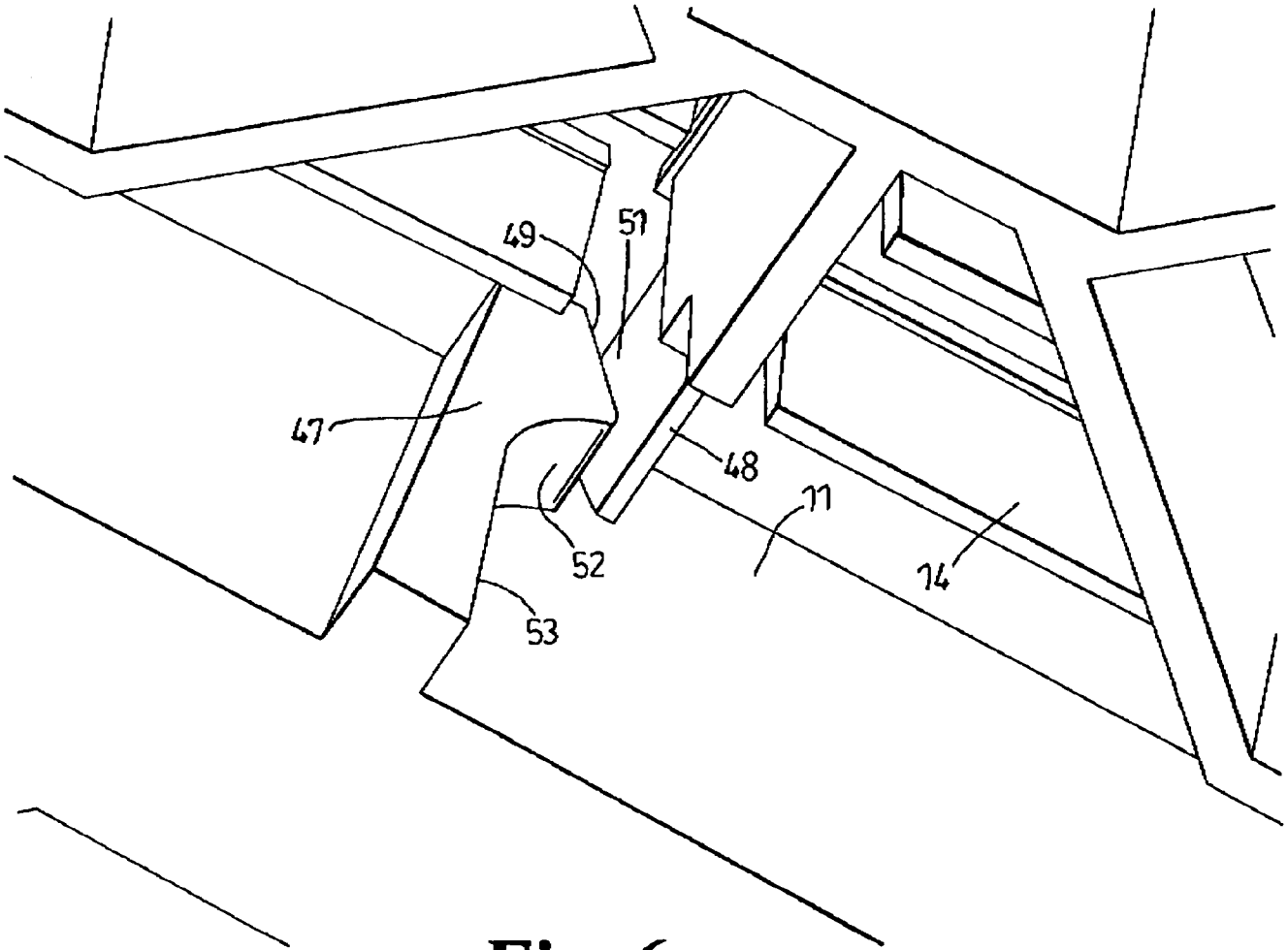
FIGS. 6 and 7 are perspective views taken respectively from below and above of the components defining a releasable lock in the assembly of the invention.

When grating 14 is hinged towards its operative position the respective surfaces 49, 51 engage one another. Downward pressure on the grating 14 then causes lock member 48 to deflect laterally relative to member 47, as shown in FIG. 6.

The underside of member 47 beneath surface 49 is undercut to define a downwardly facing shoulder 52 and a lateral restraint wall 53 that extends vertically a short distance away from the lower, free edge of surface 49.

The upper part of member 48 is cut away in a complementary fashion to define an upwardly facing surface 54 and a vertically extending lateral restraint wall 56. When member 48 is pressed downwardly so that the free edge of shoulder 54 passes the free end of shoulder 52, member 48 is urged laterally towards member 47 by the resilience thereof. Consequently shoulder 54 slides under shoulder 52 to the position visible in FIG. 7.

The biasing force resulting from the aforesaid resilience presses the walls 53, 56 into mutual engagement The downward movement of grating 14 causes the corners thereof remote from the hinges 34, 36, 37, 38 to engage the adjacent seatings 24. It therefore requires a slight overpressure on the grating 14 to overcome the resilience of the material thereof and allow the surfaces 52, 54 to slide one under the other as described. The overpressure results in an upward force tending to urge the surface 52 into contact with surface 54. This enhances the security of the lock.

Figure 7:
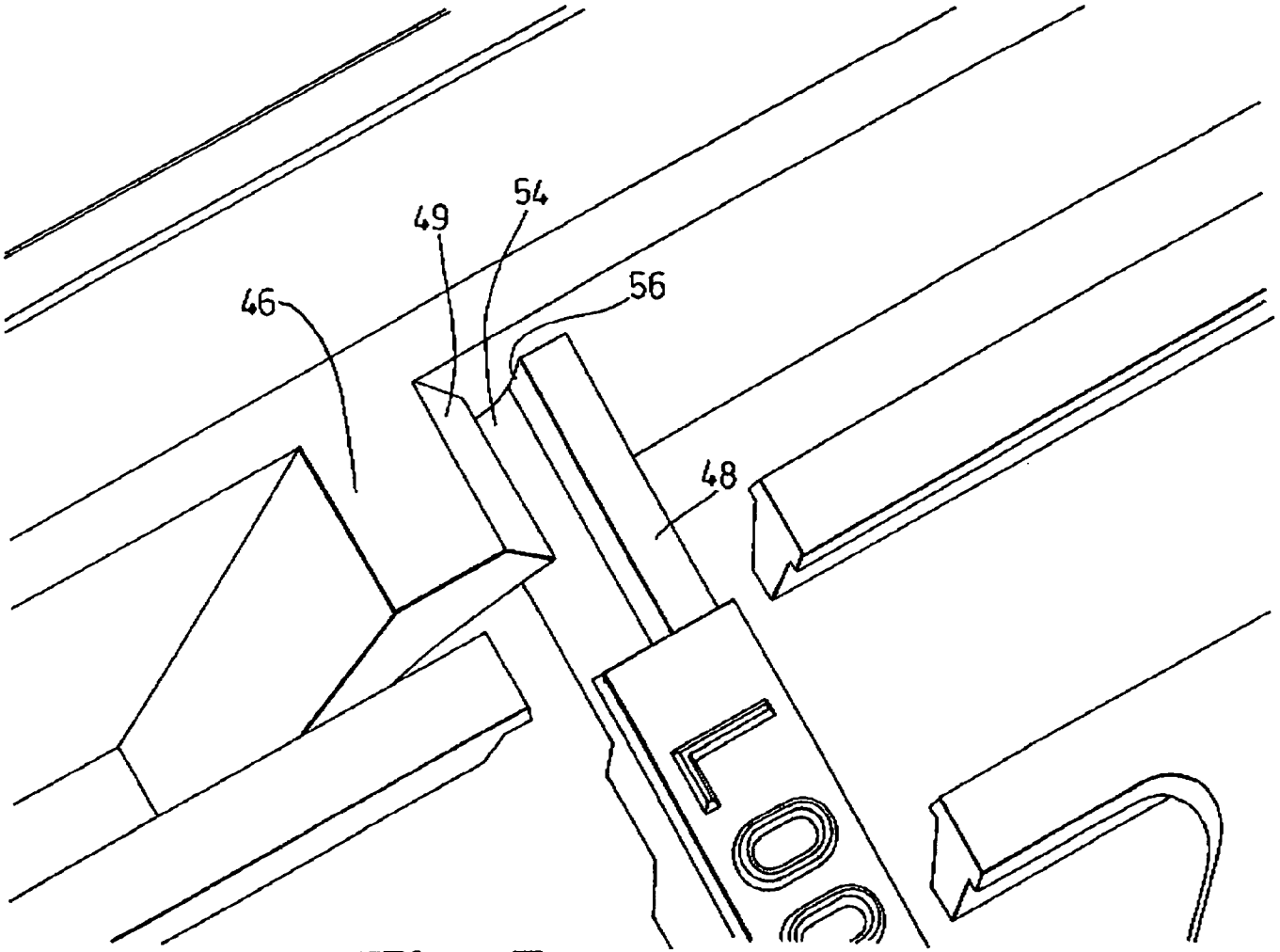

When the lock is operative as shown in FIG. 7 the shoulders 52, 54 may be arranged to be obscured eg. by tapered surface 51.

Releasing of the lock arrangement 46 may result from the prising of member 48 laterally away from member 47 (eg. using a crowbar or similar tool) to free the engaged surfaces from one another and permit upward hinging of the grating 14.

In any embodiment of the invention it is a matter of expediency whether the protuberances protrude from parts of the frame or of the grating. The journal recesses may be shaped and located to suit the protuberance arrangement chosen FIGS. 8*a*–8*c* show schematically some possible arrangements for the hinging of the grating 14 relative to the frame 11. In FIGS. 8*a*–8*c* the arrows A indicate the direction of opening of the grating 14. Numeral 57 represents a kerb in FIG. 8*c*.

In FIG. 8*a* the protuberances 39 are journalled to define a hinge axis at the right hand end of frame 11; whereas in FIG. 8*c* the grating is a mirror image whereby the protuberances 39 are journalled to define a hinge axis at the left hand end. In each of FIGS. 8*a* and 8*b* the hinge axis is therefore parallel to the shorter sides of the rectangular frame 11. Such arrangements are respectively termed "fight hand opening" and "left hand opening".

In FIG. 8*c* the grating differs in that the protuberances are journalled at the shorter sides of the rectangular fame 11 so that the hinge axis is parallel to the longer sides thereof. Consequently the hinge axis is parallel to a kerb 57 next to which the assembly 10 is installed. Such an arrangement of the hinge is termed "kerb hinging".

Figure 2:
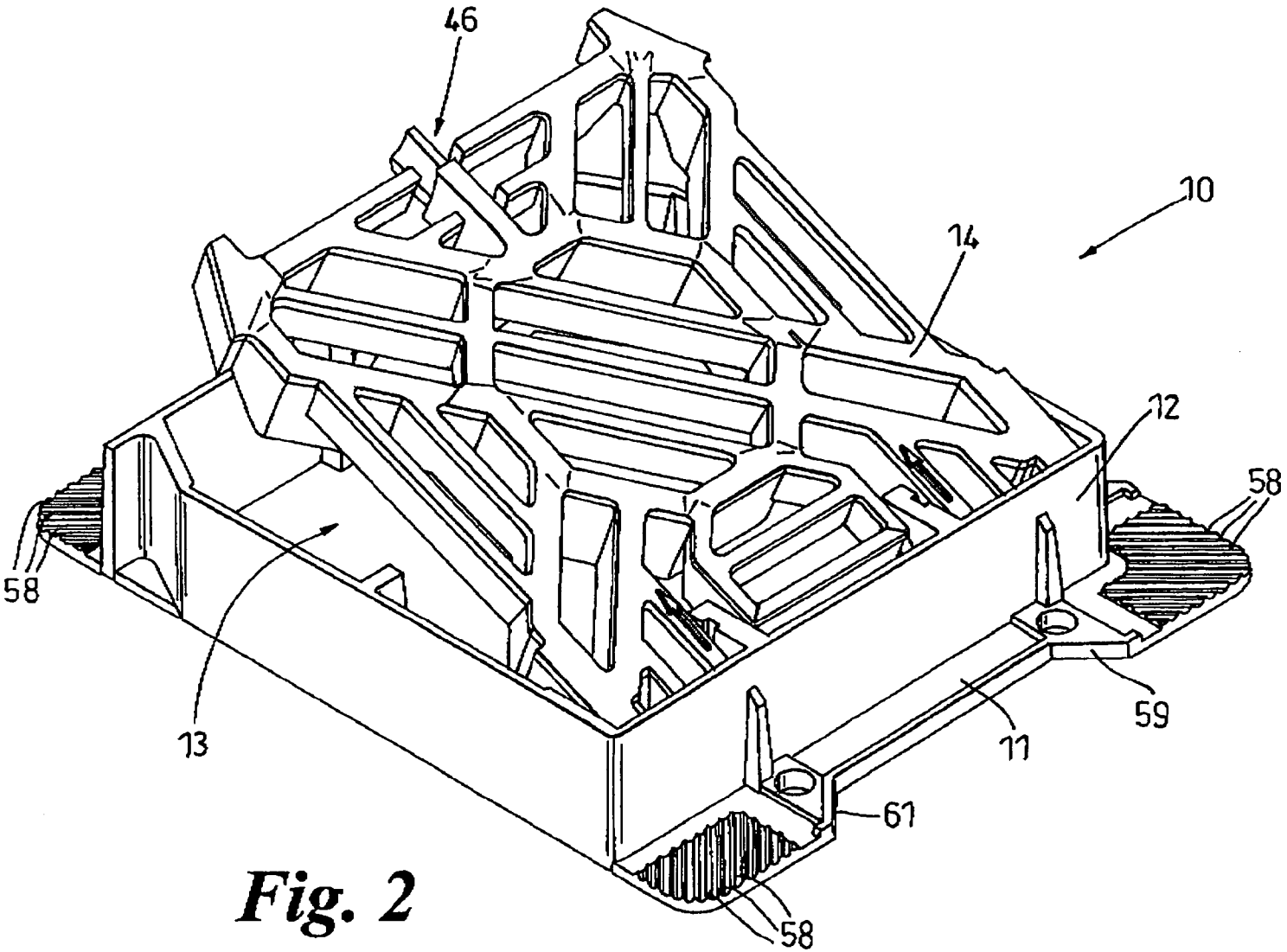
FIG. 2 is a perspective view, that is similar to FIG. 1, showing the grating hinged to an open position.

As is visible in FIGS. 1 and 2, the frame 11 has protruding from the base of wall 12 an in-use horizontal flange 59 that functions to anchor the assembly 10 eg. in mortar at the top of a drainage aperture. Flange 59 may if desired include features to enhance the strength of the frame structure and/or to improve keying of the flange to the mortar. Such features may include (but are not limited to) ribs 58 or other protrusions or recesses on the top, bottom or edge surfaces of the flange 59. Such ribs may be arranged eg. in patterns of parallel lines or in other arrangements as desired.

In the embodiment shown the ribs are present at the corners of the flange. Regardless of whether the flange is present, the ribs or equivalent formations may be present at other locations on the frame 11 as desired.

As is evident from FIGS. 1 and 3 the extent of protrusion of flange 59 from the remainder of frame 11 varies from place to place about the periphery of frame 11. This is exemplified by flange recess 61 in FIG. 1. The use of such recesses minimises material usage in the flange.

FIG. 1 shows in schematic form one way of manufacturing the frame 11, by casting a U-section member 11*a* and subsequently attaching (eg. by welding or bolting) an optional end wall 11*b*. This construction facilitates the manufacturing process.

The drainage assembly illustrated in FIG. 9 is rectangular in shape, whilst the drainage assembly illustrated in FIGS. 1 and 2 is square. It is however understood that the frame and grating of the present drainage assembly may assume any suitable shape and could, for example, be trapezoidal or triangular in shape without departing from the scope of the invention.

FIGS. 10 and 11 show a square drainage assembly with the grating 14 defined by parallel cross members 64 and a perpendicular central member 65. The upper surfaces of the cross members and central member are provided with hydraulic deflectors 66 in the form of out-of-phase surface projections. These have the effect of disrupting water flowing over the grate to slow the water flow and cause more water to fall down the drainage duct than would be the case for faster flowing water. The hydraulic deflectors have the added benefit of providing an anti-slip surface on the grating.

It is understood that the hydraulic deflectors are not effective in only disrupting the flow of water, but can be used to disrupt any substance having fluid characteristics, For instance, such fluids include chemical effluent, sludge, oil, gels other liquids, foam and flowable solids, such as pellets, sand and the like.

In the embodiment shown the hydraulic deflectors are a chevron shape raised on the grating surface. The deflectors an are aligned facing alternate directions to enhance resistance to water flow.

Other configurations of hydraulic deflector shapes are foreseeable provided the objective of deflecting water is achieved. For example, FIGS. 10 and 11 illustrate raised letters and numbers on the gating surface which also act as water deflectors. These could be applied across a greater area on the grating surface to form effective hydraulic deflectors.

The invention claimed is:

1. A drainage assembly comprising a frame for defining at least part of the surface boundary of a surface drainage aperture; and a grating having formed therein a plurality of apertures, the grating being hingedly securable to the frame and being moveable, when so secured, between an operative position in which the grating is contiguous with the frame; and an open position in which the grating lies hinged away from the frame, the frame and the grating including mutually engageable hinge parts comprising a first pair of forks protruding from the grating; and a pair of journal members secured to the frame, one of the said first pair of forks and the pair of journal members each having protruding therefrom a respective protuberance and the other of the said first pair of forks and the pair of journal members each having formed therein a respective journal recess in which said protuberance is rotatably receivable when the frame and the grating are hingedly secured together, at least one of the said forks and/or at least one of the journal members being moveable against a resilient biassing to permit fabrication and dismantling of the drainage assembly, further comprising means for substantially preventing at least one of said protuberances rotatably received in one said journal recesses from being removed from said one of said journal recesses when the grating is in the operative position.

2. A drainage assembly according to claim 1 wherein both of the first pair of forks protruding from the grating are resiliently deformable.

3. A drainage assembly according to claim 1 wherein the journal members include a second pair of forks protruding from the frame.

4. A drainage assembly according to claim 3 wherein the forks protruding from the frame are resiliently deformable.

5. A drainage assembly according to claim 1 wherein the grating, including the first pair of forks, is formed from spheroidal graphite iron having an elongation threshold of between 3% and 7%.

6. A drainage assembly according to claim 1 wherein the resilience of the or each said resiliently deformable fork permits deflection of parts of the assembly one relative to another to permit insertion of the protuberances into the recesses, during construction of the assembly.

7. A drainage assembly according to claim 6 wherein the recesses are formed in the respective journal members; and at least one of the journal members includes a groove interconnecting a free edge of the journal member and its associated recess, the groove being so dimensioned and located as to permit sliding therein of an associated said protuberance, following the said deflection, until the protuberance is received in the said associated recess.

8. A drainage assembly according to claim 7 wherein said means for substantially preventing at least one of said protuberances rotatably received in one of said journal recesses from being removed from said one of said journal recesses when the grating is in the operative position comprises the cross-sectional shape of the said associated protuberance having major and minor axes whereby the protuberance is slideable in the groove only when the grating is inclined at a predetermined angle relative to the frame.

9. A drainage assembly according to claim 8 wherein when the grating adopts a predetermined angle relative to the frame, following receipt of the said protuberance in its associated recess, the recess obscures from external view the existence of the minor axis of the cross-sectional shape of the protuberance.

10. A drainage assembly according to claim 8 wherein the predetermined angle is between 0° and 90°.

11. A drainage assembly according to claim 1 including a releasable lock arrangement for securing the grating in its operative position, the lock arrangement comprising a first lock member protruding from the frame and a second lock member protruding from part of the grating, the first and second lock members being: (i) moveable transversely relative to one another against a resilient biassing; and (ii) positioned such that on hinging of the grating to its operative position the second lock member passes downwardly past the first lock member following or during transverse relative movement between the lock members; the lock members including, when the lock is operative to secure the grating in its operative position, a first pair of mutually juxtaposed surfaces that react against the resilient biassing; and a second pair of mutually juxtaposed surfaces that oppose a second resilient biassing tending to hinge the grating towards its open position.

12. A drainage assembly according to claim 11 wherein when the lock arrangement is in use to secure the grating in its operative position the first lock member obscures at least one of the pairs of juxtaposed surfaces, when the drainage assembly is viewed from above.

13. A drainage assembly according to claim 1 wherein the frame is rectangular and the axis of hinging of the grating is parallel to the shorter sides of the rectangle defined by the flame.

14. A drainage assembly according to claim 1 wherein the frame is rectangular and the axis of hinging of the gratings is parallel to the longer sides of the rectangle defined by the frame.

15. A drainage assembly according to claim 1 wherein the frame is rectangular and is formed from an integral, generally U-shaped member having a plate secured thereto interconnecting the free ends of the limb of the "U".

16. A drainage assembly according to claim 1, wherein the frame includes an anchor for securing the assembly relative to a surface drainage aperture.

17. A drainage assembly according to claim 16 wherein the anchor includes one or more protrusions or recesses formed on the frame for keying the frame in a bedding medium.

18. A drainage assembly according to claim 17 wherein the protrusions or recesses additionally stiffen the frame against bending.

19. A drainage according to claim 17 wherein the frame includes protruding therefrom a flange; and wherein the protrusions or recesses are formed in or on a surface of the flange.

20. A drainage assembly according to claim 1 wherein the frame includes protruding therefrom a flange, the extent of protrusion of the flange varying from place to place about the periphery of the frame.

21. A drainage assembly according to claim 1 wherein the frame defines a continuous boundary.

22. A drainage assembly according to claim 1 wherein projections are provided on the upper surface of the grating to slow the flow of fluids over the assembly.

23. A drainage assembly according to claim 22 wherein the projections are raised shapes and/or lettering on the grating surface.

* * * * *